US011855394B2

(12) United States Patent
Blakborn

(10) Patent No.: US 11,855,394 B2
(45) Date of Patent: Dec. 26, 2023

(54) ELECTRICAL PLUG CONNECTOR AND ELECTRICAL CONNECTING ARRANGEMENT

(71) Applicant: Rosenberger Hochfrequenztechnik Gmbh & Co. KG, Fridolfing (DE)

(72) Inventor: Willem Blakborn, Inzell (DE)

(73) Assignee: Rosenberger hochfrequenztechnik GmbH & Co. KG, Fridolfing. (DE)

( * ) Notice: Subject to any disclaimer, the term of this patent is extended or adjusted under 35 U.S.C. 154(b) by 0 days.

(21) Appl. No.: 17/357,475

(22) Filed: Jun. 24, 2021

(65) Prior Publication Data

US 2021/0408740 A1 Dec. 30, 2021

(30) Foreign Application Priority Data

Jun. 24, 2020 (EP) ..... 20181901

(51) Int. Cl.
*H01R 24/60* (2011.01)
*H01R 13/6587* (2011.01)
*H01R 13/66* (2006.01)

(52) U.S. Cl.
CPC ..... *H01R 24/60* (2013.01); *H01R 13/6587* (2013.01); *H01R 13/6658* (2013.01)

(58) Field of Classification Search
CPC .... H01R 12/585; H01R 43/205; H01R 24/60; H01R 13/6587; H01R 13/6658
(Continued)

(56) References Cited

U.S. PATENT DOCUMENTS 4,045,868 A * 9/1977 Ammon ..... H01R 12/585 439/943
4,619,495 A * 10/1986 Sochor ..... H01R 43/205 439/943

(Continued)

FOREIGN PATENT DOCUMENTS

DE 102012218433 A1 4/2014
DE 102017215515 A1 3/2019

(Continued)

OTHER PUBLICATIONS

European Search Report dated Nov. 11, 2020.

*Primary Examiner* — Gary F Paumen
(74) *Attorney, Agent, or Firm* — Randall Danskin P.S.

(57) ABSTRACT

An electrical plug connector, having an insulating part and an inner-conductor contact element pair for differential signal transmission. The inner-conductor contact element pair comprises first and second inner-conductor contact elements, which extend through the insulating part. The inner-conductor contact elements, proximate a first end of the insulating part, have a contact section for contacting an inner conductor of a corresponding counterpart plug connector and proximate a second end of the insulating part, have a press-in pin for pressing into a metal-plated recess of an electrical assembly. The inner-conductor contact elements each have one support shoulder via which a pressing-in force can be introduced for pressing the press-in pin into the metal-plated recess. The support shoulder is along the central axis of the inner-conductor contact element. The inner-conductor contact elements each have a support surface averted from the support shoulder to support the inner-conductor contact element in the insulating part.

21 Claims, 4 Drawing Sheets

(58) Field of Classification Search
USPC ..... 439/943
See application file for complete search history.

(56) References Cited

U.S. PATENT DOCUMENTS 5,139,446 A * 8/1992 Costello ..... H01R 13/42
439/82
5,453,016 A * 9/1995 Clark ..... H01R 12/724
439/79
5,639,269 A * 6/1997 Vanbesien ..... H01R 13/41
439/943
5,743,769 A * 4/1998 Koguchi ..... H01R 12/585
439/943
6,109,933 A * 8/2000 Lenoir ..... H01R 13/6585
439/943
6,312,296 B1 * 11/2001 Jones ..... H01R 13/41
439/943
7,175,447 B2 * 2/2007 Pan ..... H01R 12/727
439/943
8,092,262 B1 * 1/2012 Frederick ..... H01R 12/585
439/943
8,727,815 B1 * 5/2014 Mongold ..... H01R 43/22
439/943

FOREIGN PATENT DOCUMENTS

EP 3618194 A1 3/2020
JP 2011154894 A 8/2011

* cited by examiner

ELECTRICAL PLUG CONNECTOR AND ELECTRICAL CONNECTING ARRANGEMENT

CROSS REFERENCE TO RELATED APPLICATIONS

This Non-Provisional Patent Application is a United States National Stage Patent Application which claims the benefit of priority to earlier filed European Patent Application No. 20 181 901.8, which was filed on 24 Jun. 2020. The entire contents of the aforementioned earlier filed European Patent Application is expressly incorporated herein by this reference.

Pursuant to USPTO rules, this foreign priority claim to earlier filed European Patent Application No. 20 181 901.8 is also included in the Application Data Sheet (ADS) filed herewith.

TECHNICAL FIELD

The invention relates to an electrical plug connector, having an insulating part and at least one inner-conductor contact element pair for differential signal transmission, wherein the inner-conductor contact element pair comprises a first inner-conductor contact element and a second inner-conductor contact element, which extend through the insulating part from a first end of the insulating part to a second end of the insulating part.

The invention furthermore relates to an electrical connecting arrangement having an electrical plug connector and an electrical assembly, in particular an electrical circuit board.

BACKGROUND

Various electrical plug connectors are known from the field of electrical engineering. Electrical plug connectors serve, as is known, for transmitting electrical supply signals and/or data signals to corresponding electrical counterpart plug connectors. A plug connector, or counterpart plug connector, may be in particular a plug, a circuit board connector, a panel connector, a socket, a coupling or an adapter. The term "plug connector" or "counterpart plug connector" used in the context of the invention is representative of all variants.

High demands are placed in particular on the robustness and reliability of plug connectors for the automotive industry or for vehicles. Accordingly, a plug connection must withstand sometimes high loads, for example mechanical loads, and remain closed in defined fashion, such that the electrical connection is not inadvertently severed for example during the operation of the vehicle. Ensuring reliability is of primary concern in particular in the case of the autonomous operation of vehicles and for driver assistance systems.

In the case of the autonomous operation of a vehicle, or in the case of assistance systems being used, it is sometimes necessary for large amounts of data from several cameras, various sensors and navigation sources to be combined with one another and transported, normally in real time. The operation of numerous devices, screens and cameras accordingly requires a high-performance infrastructure in the vehicle electronics system. Accordingly, the demands on the plug connectors and the cable connections within a vehicle with regard to the required data rate have, over time, become very high. To save structural space and weight, it is furthermore important for the plug connectors to be designed to be as compact as possible.

A further demand on plug connectors for the automotive industry consists in that these connections should be producible economically in high unit quantities and should be easy and reliable to assemble.

For the transmission of data with high data rates, an electrical plug connector commonly has a differential inner conductor contact element pair. Here, the quality of the signal transmission is significantly dependent on the transition resistance between the inner-conductor contact elements and an electrical assembly connected to the electrical plug connector, and the adaptation of the characteristic impedance in the electrical plug connector. With regard to the connection to the electrical assembly, in particular an electrical circuit board, the suitability of the plug connector for mass production should also be taken into consideration, and the outlay for the assembling of the plug connector on the electrical assembly should be kept low.

The electrical and mechanical contacting between the inner-conductor contact elements of the electrical plug connector and the electrical assembly is often realized in practice by means of a so-called oversize fit or "interference fit". For this purpose, press-in pins are pressed with a certain pressing-in pressure into associated metal-plated recesses of the electrical assembly. This causes cold welding, and a cohesive connection forms between the press-in pins and the recesses.

For a centered pressing-in action, and in order to avoid formation of cracks and fractures in the electrical assembly, the most symmetrical possible pressing-in pressure should be exerted on the respective press-in pin. For this purpose, in practice, the press-in pins each have two oppositely situated support shoulders, via which the pressing-in force is transmitted correspondingly uniformly.

It has been found that, in particular, the directly oppositely situated support shoulders of two inner-conductor contact elements of a common inner-conductor contact element pair have a non-negligible capacitive influence on the characteristic impedance. In this way, the suitability of the plug connector for transmitting particularly high-frequency electrical signals can be reduced.

In view of the known prior art, the object of the present invention therefore consists in providing an electrical plug connector which is suitable for transmitting signals with high data rates and which can be produced economically and assembled easily preferably in a mass production context.

The present invention provides an improved electrical connecting arrangement which can be advantageously suitable for use in high-frequency technology.

The features described/disclosed herein, including described/disclosed in the claims concern advantageous embodiments and variants of the invention.

An electrical plug connector is provided, having an insulating part, or dielectric, and at least one inner-conductor contact element pair for differential signal transmission. The inner-conductor contact element pair has a first inner-conductor contact element and a second inner-conductor contact element. The inner-conductor contact elements extend through the insulating part from a first end of the insulating part to a second end of the insulating part. The inner-conductor contact elements, in the region of the first end of the insulating part, have a contact section for contacting an inner conductor of a corresponding counterpart plug connector and, in the region of the second end of the insulating part, have a press-in pin (also known under the expression "press-fit pin") for pressing (in particular in accordance with a so-called "oversize fit") into a metal-plated recess defined in an electrical assembly.

A first end of the insulating part may be formed in particular in a region of the "front" end of the insulating part, or in the region of the front end of the electrical plug connector equipped with the insulating part. A second end of the insulating part may be formed in particular in the region of a "rear" end of the insulating part or in the region of the rear end of the electrical plug connector equipped with the insulating part. The two ends may preferably be arranged at oppositely situated ends (along a longitudinal axis or central axis) of the insulating part or of the electrical plug connector equipped with the insulating part.

The press-in technique is known in particular as a connecting technique in the field of electrical circuit boards, and has proven successful for producing solder-free electrical connections. In the case of this technique, an outer diameter of the press-in pins is slightly larger than an inner diameter of the metal-plated recesses. The "over-pressing" that arises during the pressing-in process can be accommodated by deformation in the recess or in the press-in pin. Owing to the action of the force that is built up, a cohesive, cold-welded and gas-tight connection forms.

The use of the oversize fit for the connection of the electrical plug connector to the electrical assembly can be advantageous because, for example, no thermal loading of the components involved occurs. The press-in connections can furthermore be produced very easily and quickly. Furthermore, the gas-tight connection can durably counteract ageing and corrosion of the plug connector.

The insulating part is preferably of single-part form, though may possibly also be of multi-part form. The insulating part may, for example, optionally have seals and/or fastening elements, for example detent elements.

The insulating part is preferably formed exclusively from an electrically insulating or dielectric material. The insulating part may however, also have electrically conductive components, for example only, and not limited to, connecting elements for connecting the plug connector to an electrical circuit board or to a corresponding counterpart plug connector, for example spring tabs, screw elements and/or detent elements.

The insulating part may be formed partially, substantially or preferably entirely from a plastic.

The inner-conductor contact elements have in each case, exactly one support shoulder via which a pressing-in force that is required for the pressing of the press-in pin into the metal-plated recess can be introduced (indirectly or directly, preferably proceeding from a suitable assembling tool). The support shoulder is formed between the contact section and the press-in pin along a central axis of the inner-conductor contact element. The inner-conductor contact elements furthermore have a respective support surface which is averted from the support shoulder and by way of which the inner-conductor contact element is supported in the insulating part.

The support shoulder extends preferably orthogonally with respect to the central axis of the inner-conductor contact element or along an orthogonal with respect to the central axis of the inner-conductor contact element. The support shoulder may however also run along an angle relative to the central axis which deviates from 90°.

The proposed inner-conductor contact element is preferably of asymmetrical design.

By virtue of the fact that, each of the contact elements of the common inner-conductor contact element pair has only a single support shoulder, the introduction of capacitance is advantageously reduced, whereby the electrical plug connector can be suitable for transmitting signals with particularly high data rates.

In order to press the respective inner-conductor contact element symmetrically into the metal-plated recess of the electrical assembly despite the only unilateral shoulder, and despite the asymmetrical configuration thereof, that support surface which is averted from the support shoulder can advantageously serve for supporting the inner-conductor contact element in the insulating part.

The support surface is preferably arranged directly opposite the support shoulder along the central axis of the inner-conductor contact element. The support surface preferably extends over a larger axial section along the central axis of the inner-conductor contact element than the support shoulder. In this way, the guidance of the inner-conductor contact element within the insulating part can be further improved, and the inner-conductor contact element can be supported particularly effectively.

The proposed electrical plug connector can be producible in a material-saving and thus not least particularly economic manner—with a simultaneously simple assembling process.

In one refinement of the invention, it may be provided that the electrical plug connector has an outer-conductor assembly. The outer-conductor assembly may comprise a first interface for the electrical and mechanical contacting of an outer conductor of the corresponding electrical counterpart plug connector, and a second interface for the electrical and mechanical contacting of the electrical assembly. The insulating part is preferably received in the outer-conductor assembly and positioned with a first end in the first interface and with a second end in the second interface (or with its first end on the first interface and with its second end on the second interface).

The outer-conductor assembly is preferably of single-part form, although the outer-conductor assembly may also be of multi-part form.

The outer-conductor assembly may optionally have, adjoining the first interface, a spring cage for connection to the outer conductor of a corresponding counterpart plug connector.

The outer-conductor assembly is preferably formed entirely from an electrically conductive material. The outer-conductor assembly may however, also have electrically insulating components, for example seals and/or detent elements composed of plastic. The outer-conductor assembly is preferably designed to electromagnetically shield plug connector components of the electrical plug connector. The outer-conductor assembly is preferably furthermore designed to provide an impedance-controlled electrical transition between the electrical assembly and the counterpart plug connector.

The outer-conductor assembly may be formed partially, substantially or preferably entirely from a metal, preferably sheet metal.

The outer-conductor assembly is preferably of sleeve-shaped form in order to correspondingly encase plug connector components, which are to be electromagnetically shielded, of the electrical plug connector, in particular the inner-conductor contact elements of a common inner-conductor contact element pair.

The outer-conductor assembly may have a rectilinear, curved or angled profile, in particular also a right-angled profile for use in an angled plug connector.

For the contacting of the electrical assembly, the second interface of the outer-conductor assembly may have a multiplicity of contact elements. In particular, it may be provided that the contact elements, like the inner-conductor contact elements, are designed as press-in pins (for distinction, the press-in pins of the outer-conductor assembly will hereafter also be referred to as "press-in contacts") for an oversize fit in the metal-plated recesses defined in the electrical assembly. Alternatively, or in addition, a configuration of the contact elements as resilient contact elements for insertion into the metal-plated recesses defined in the electrical assembly may for example also be provided. It is very particularly preferably possible for a first group of the contact elements to be designed as press-in contacts, and for a second group of the contact elements to be designed as resilient contact elements. In this way, the number and/or density of contact elements can advantageously be increased without the risk of assembly-induced damage to, or fracture of, the electrical assembly, for example of an electrical circuit board. Owing to the increased density of contact elements or the reduction of the minimum spacing between the contact elements, it is ultimately possible for the shielding action of the outer-conductor assembly to be increased, and for the transition resistance to be reduced, in order to provide an electrical plug connector for transmitting signals with even higher frequencies.

The electrical plug connector may also have multiple outer-conductor assemblies, for example two or even more outer-conductor assemblies, four or even more outer-conductor assemblies, or eight or even more outer-conductor assemblies. It is preferable if each outer-conductor assembly electromagnetically shields exactly two inner-conductor contact elements or one inner-conductor contact element pair.

The outer diameters of the press-in pins of the inner-conductor contact elements and/or of the press-in contacts of the outer-conductor assembly are preferably larger than the inner diameters of the corresponding metal-plated recesses defined in the electrical assembly. The "over-pressing" that arises during the pressing-in process can ultimately be accommodated by the press-in pin or the press-in contact and/or the metal-plated recess.

The press-in pins of the inner-conductor contact elements and/or the press-in contacts of the outer-conductor assembly may, at their respective free ends, have an insertion section, the outer diameter of which is smaller than the inner diameter of the metal-plated recesses. It may be provided that the cross section of the press-in pin, or of the press-in contact widens proceeding from the insertion section. The insertion of the press-in pin, or press-in contact can be facilitated in this way. Furthermore, in this way, the pressing-in pressure required for the pressing of the press-in pin, or press-in contact, into the recess can increase continuously during the pressing-in process which can further reduce the mechanical load for the components involved.

In one configuration of the invention, it may be provided that the press-in pins of the inner-conductor contact elements and/or the press-in contacts of the outer-conductor assembly have an elastic deformation zone at least along a section of their longitudinal axis. The deformation zone is preferably formed by a central material recess. The press-in pins, or press-in contacts, may in particular have an elongate material recess, or a slot, or a groove oriented along the longitudinal axis of the press-in pin, or press-in contact. It is also possible for multiple material recesses to be provided, which are preferably arranged so as to be distributed along the longitudinal axis of the respective press-in pin or press-in contact. The press-in pin or press-in contact may however basically also be of solid design.

In one configuration of the invention, it may be provided that the outer-conductor assembly is formed as a single piece, preferably from a stamped and bent part. The outer-conductor assembly may in particular be formed as a single piece with the contact elements thereof. It may however also be provided that the outer-conductor assembly and the contact elements are of multi-part form. Production of the outer-conductor assembly as a single piece from a metal sheet can be particularly suitable for mass production.

In one advantageous configuration of the invention, it may be provided that the outer-conductor assembly, in particular the contact elements, and/or the inner-conductor contact elements, are formed from aluminum bronze.

The outer-conductor assembly and/or the inner-conductor contact elements may be formed from any metal or any metal alloy (also from respectively different metals or metal alloys). The outer-conductor assembly and/or the inner-conductor contact elements may be formed for example only, and not limited to, from brass, bronze and/or beryllium copper. The inventors have however identified that aluminum bronze can be suitable for a particularly good connection between the electrical plug connector and the electrical assembly.

The surface of the outer-conductor assembly and/or of the inner-conductor contact elements may be blank, nickel-plated, tin-plated, gold-plated and/or palladium-plated.

In one refinement of the invention, it may be provided that the electrical plug connector has an insulating housing assembly with a mechanical interface for the connection of the electrical plug connector to the corresponding counterpart plug connector.

Preferably, the outer-conductor assembly is received in the housing assembly (particularly preferably in positively locking and/or non-positively locking fashion) and positioned with its first interface in the mechanical interface. A reversed arrangement may however also be provided, in which the housing assembly is received in the outer-conductor assembly, preferably in positively locking and/or non-positively locking fashion.

The mechanical interface of the housing assembly may have means for mechanical coding, in particular for ensuring a correct orientation of the plug connector and of the counterpart plug connector and/or for ensuring that only admissible counterpart plug connectors can be mechanically connected to the plug connector. The mechanical interface may have detent means for detent engagement between the plug connector and the counterpart plug connector. The mechanical interface may have one or more seals.

It may be provided that the outer-conductor assembly projects with an end section out of the housing assembly at a second (rear) end of the housing assembly which is situated opposite the mechanical interface. In this way, a mechanical and/or electrical connection to the electrical assembly (for example a cable, a device housing or an electrical circuit board) can be made possible in a particularly simple manner.

The electrically insulating housing assembly is preferably of single-part form, although the electrically insulating housing assembly may also be of multi-part form. The housing assembly may for example optionally have seals and/or fastening elements.

The electrically insulating housing assembly is preferably formed exclusively from an electrically insulating material. The electrically insulating housing assembly may however also have electrically conductive components, for example only, and not limited to, connecting elements for connecting the plug connector to an electrical circuit board or to a corresponding counterpart plug connector, for example spring tabs, screw elements and/or detent elements.

The electrically insulating housing assembly may be formed partially, substantially or preferably entirely from a plastic.

The outer-conductor assembly may optionally have at least one fastening tab that can be bent from a basic state into a fastening state in order to fasten the outer-conductor assembly to the electrically insulating housing assembly during the course of the plug connector assembling process. By means of the proposed fastening, a solid undercut can be provided between the electrically insulating housing assembly and the outer-conductor assembly, in this way, the electrically insulating housing assembly can be significantly secured on the outer-conductor assembly (or vice versa), preferably such that pulling-off in a forward direction or counter to the plugging-in direction of a corresponding counterpart plug connector is prevented. Alternatively, it is however also possible for some other fastening to be provided between the outer-conductor assembly and the electrically insulating housing assembly, for example an interference fit or a fastening by means of fastening claws.

The electrically insulating housing assembly may possibly be designed to receive more than one outer-conductor assembly, for example two outer-conductor assemblies or more outer-conductor assemblies, three outer-conductor assemblies or more outer-conductor assemblies, four outer-conductor assemblies or even more outer-conductor assemblies. Alternatively, or in addition, it may be provided that the at least one outer-conductor assembly is designed to shield multiple inner-conductor contact elements separately from one another. Preferably, the outer-conductor assembly is designed to shield in each case two inner-conductor contact elements of a common inner-conductor contact element pair jointly from further inner-conductor contact elements/inner-conductor contact element pairs that are possibly present.

The electrical plug connector may have any number of inner-conductor contact element pairs, for example only, and not limited to, one or more individual inner-conductor contact elements in addition to an inner-conductor contact element pair. Preferably, the electrical plug connector however has one to six inner-conductor contact element pairs, in particular exactly one inner-conductor contact element pair, exactly two inner-conductor contact element pairs or exactly four inner-conductor contact element pairs.

In addition to the insulating part, the electrically insulating housing assembly, the outer-conductor assembly and the inner-conductor contact elements, the electrical plug connector may also have further plug connector components, for example seals or fastening elements for fastening to an electrical assembly (for example to a cable or to a circuit board).

In one advantageous refinement of the invention, it may be provided that the support shoulder directly adjoins the press-in pin along the central axis of the inner-conductor contact element.

In this way, the pressing-in force can be introduced particularly effectively and precisely.

In one refinement of the invention, it may be provided that the first inner-conductor contact element, and the second inner-conductor contact element are arranged and formed in axially symmetrical fashion along the longitudinal axis of the insulating part.

By means of an axially symmetrical or mirror-symmetrical arrangement of the inner-conductor contact elements of a common inner-conductor contact element pair, the impedance of the plug connector can be controlled in a particularly advantageous manner.

In one refinement of the invention, it may be provided that the support shoulder of the first inner-conductor contact element, and the support shoulder of the second inner-conductor contact element extend in opposite directions, preferably along a common orthogonal relative to the respective central axis of the inner-conductor contact element.

Thus, in the state in which they are assembled in the electrical plug connector, the inner-conductor contact elements may preferably have no "internally situated" support shoulders but in each case "externally situated" support shoulders.

The support shoulders of adjacent inner-conductor contact elements of a common inner-conductor contact element pair preferably point in the opposite direction, which further reduces the introduction of capacitance and improves the signal transmission. It has been found that a low introduction of capacitance is realized in particular if the support shoulders each extend along a common orthogonal relative to the respective central axis of the inner-conductor contact element.

In one refinement of the invention, it may be provided that the insulating part, the outer-conductor assembly and/or the housing assembly have at least one engagement surface for an assembling tool, by which engagement surface the pressing-in force for the pressing of the press-in pins into the metal-plated recesses can be introduced from the assembling tool into the support shoulders.

The pressing-in force may basically also be introduced directly into the respective support shoulder. The introduction of the pressing-in force via the insulating part, the outer-conductor assembly and/or the housing assembly is however preferred. The housing assembly preferably has the engagement surface.

The engagement surface is preferably arranged directly above the inner-conductor contact element or the metal-plated recess in the pressing-in direction.

In one refinement of the invention, it may be provided that the insulating part has, on its inner side, rib-like extensions with a respective lateral abutment surface that faces the electrical assembly and against which the corresponding support shoulder bears in order to transmit the pressing-in force.

Via the rib-like extensions, the pressing-in force can be introduced particularly reliably into the corresponding support shoulder.

In one advantageous refinement of the invention, it may be provided that the lateral abutment surface is formed so as to be recessed in the rib-like extension or behind a set-back portion in order to provide a stop for the corresponding support shoulder.

A corresponding set-back portion can provide positive locking for the support shoulder on the abutment surface. The inner-conductor contact element can thus, with its support shoulder, be positioned and oriented on the abutment surface in a particularly optimal manner, preferably engaged with detent action behind the set-back portion.

In one refinement of the invention, it may be provided that the inner-conductor contact elements are supported with their support surfaces in the insulating part via respective guide surfaces formed on the inner side of the insulating part.

The guidance of the respective inner-conductor contact element may be realized preferably by means of a corresponding guide wall of the insulating part, which guide wall forms the guide surface.

The guide surfaces are formed in the insulating part preferably by the surface, facing toward the respective inner-conductor contact element or the respective support surface, of an intermediate wall, which runs between the inner-conductor contact elements, in the insulating part.

The guide surface or the guide wall extends preferably at least over the entire axial extent of the support surface of the inner-conductor contact element.

In one advantageous refinement of the invention, it may be provided that the inner-conductor contact elements are led through the insulating part in each case between the support surface and the rib-like extension.

The insulating part may advantageously provide a guide channel for the respective inner-conductor contact element. By means of the guide channel, the respective inner-conductor contact element can be optimally oriented and positioned in the insulating part, wherein, at the same time, the pressing-in force can be introduced into the respective support shoulder in an extremely precise and component-preserving manner.

In one advantageous refinement of the invention, it may be provided that the contact sections of the inner-conductor contact elements are designed as pin contacts or as bushing contacts.

The contact sections of the inner-conductor contact elements may however basically be of any design, wherein the respective configuration may be dependent in particular on the field of use of the electrical plug connector.

The electrical plug connector is preferably in the form of a circuit board plug connector (plug or socket) or in the form of a cable plug connector (plug or coupling).

The electrical plug connector may preferably be in the form of an angled plug connector. The electrical plug connector may however also be of non-angled form.

The electrical plug connector may in particular be designed to provide a modular plug connector system, for example an H-MTD plug connector. The electrical plug connector is however not limited to a specific plug connector type, wherein the invention is particularly suitable for plug connectors for high-frequency technology. It may in particular also be a plug connector of type such as, but not limited to, PL, BNC, TNC, SMBA (FAKRA), SMA, SMB, SMS, SMC, SMP, BMS, HFM (FAKRA-Mini), BMK, Mini-Coax or MATE-AX.

The plug connector may particularly advantageously be used within a vehicle, in particular, but not limited to, a motor vehicle. Here, the expression "vehicle" describes any means of transport, in particular vehicles for use on land, on water or in the air, and also includes spacecraft. Possible fields of use are, but are not limited to, autonomous driving, driver assistance systems, navigation systems, "infotainment" systems, rear-seat entertainment systems, Internet connections and Wireless Gigabit (IEEE 802.11ad standard). Possible applications relate to, but are not limited to, high-resolution cameras, for example 4K and 8K cameras, sensor arrangements, on-board computers, high-resolution screens, high-resolution dashboards 3D navigation units and mobile radio units.

The plug connector is suitable for any applications within the entire field of electrical engineering, and is not to be understood as being limited to use in automotive engineering.

In one advantageous refinement of the invention, it may be provided that the inner-conductor contact elements are each of single-piece form. The inner-conductor contact elements may however also be of multi-part form.

The invention also relates to an electrical connecting arrangement having an electrical plug connector as disclosed/described herein and an electrical assembly, in particular an electrical circuit board.

The electrical connecting arrangement may preferably be designed as a connecting arrangement composed of an electrical circuit board connector and of an electrical circuit board. It is however possible for any connecting arrangement composed of an electrical plug connector and of an electrical assembly to be provided, for example also an electrical cable plug connector, which is fastened to an electrical assembly in the form of a cable, or an electrical device plug connector, which is fastened to a device housing of an electrical assembly.

It is advantageously possible for an electrical connecting arrangement to be provided in the case of which the assembling of the electrical plug connector on the electrical assembly can be considerably improved.

It is advantageously furthermore possible for the space requirement of the electrical plug connector or the size of the electrical plug connector to be reduced, whereby the electrical plug connector takes up less structural space on the electrical assembly.

The proposed electrical connecting arrangement can be advantageously suitable for transmitting electrical signals with particularly high data rates.

In one refinement of the invention, it may be provided that the metal-plated recesses are formed as plated through-holes ("vias") and/or blind bores in the electrical assembly, in particular in the electrical circuit board.

The invention also relates to a method for assembling an electrical plug connector, in which method at least one inner-conductor contact element (in particular an inner-conductor contact element) is inserted with a first end into a corresponding slot of an insulating part of the electrical plug connector and is subsequently bent along a guide channel of the insulating part.

The inner-conductor contact element is preferably bent through 90° in order to form a single-piece inner-conductor contact element for an angled plug connector.

It may preferably be provided that a support shoulder of the inner-conductor contact element is, as a result of the bending process, placed in engagement with a lateral abutment surface of a rib-like extension within the insulating part.

The insulating part, which is equipped with at least one inner-conductor contact element, preferably with at least one differential inner-conductor contact element pair (composed of a first inner-conductor contact element and a second inner-conductor contact element) may preferably be subsequently inserted into, and engaged with detent action in, an outer-conductor assembly of the plug connector. The outer-conductor assembly equipped with the insulating part may preferably be subsequently inserted into a housing assembly and fastened to the housing assembly.

The further features of the present description and of the patent claims relate to advantageous embodiments and variants of the assembly method.

The invention also relates to an inner-conductor contact element, wherein the inner-conductor contact element has, at one of its ends, a press-in pin for pressing into a metal-plated recess of an electrical assembly, and wherein the inner-conductor contact element has a support shoulder formed on one side, via which a pressing-in force required for the pressing-in of the press-in pin can be introduced.

The further features of the present description and of the patent claims relate to advantageous embodiments and variants of the inner-conductor contact element.

Features that have been described in conjunction with the electrical plug connector can of course also be advantageously applied to the electrical connecting arrangement—and vice versa. Advantages that have been mentioned in relation to the electrical plug connector can furthermore also be understood in terms of the electrical connecting arrangement—and vice versa.

In addition, it should be noted that expressions such as "comprising", "having" or "with" do not exclude any other features or steps. Furthermore, expressions such as "a" or "the" that refer in the singular to steps or features do not exclude a plurality of features or steps—and vice versa.

Note that terms such as "first" or "second" etc. are used predominantly for the sake of distinguishability between respective device or method features, and are not imperatively intended to indicate that features are mutually dependent or relate to one another. Furthermore, the expression part "inner conductor" of the inner-conductor contact elements/inner-conductor contact element pairs is not to be understood as meaning that an outer conductor or the outer-conductor assembly imperatively has to be provided.

In the context of the invention, a longitudinal axis or central axis may preferably be an axis of symmetry of the respective component.

It is furthermore emphasized that the values and parameters described in the present case also encompass deviations or fluctuations of ±10% or less, preferably ±5% or less, more preferably ±1% or less, and very particularly preferably ±0.1% or less, of the respectively stated value or parameter, if such deviations are not ruled out in practice in the implementation of the invention. The specification of ranges by way of start and end values also encompasses all values and fractions encompassed by the respectively stated range, in particular the start and end values and a respective mean value.

The invention also relates to an electrical plug connector having a first inner-conductor contact element and a second inner-conductor contact element which can each be inserted at least partially into a metal-plated recess an electrical assembly, wherein the inner-conductor contact elements each have exactly one support shoulder via which a pressing-in force required for the insertion of the inner-conductor contact element into the metal-plated recess can be introduced. The features of the claims and the features described/disclosed in the herein relate to advantageous embodiments and variants of this plug connector.

Exemplary embodiments of the invention will be described in more detail below with reference to the Figures.

The Figures each show preferred exemplary embodiments in which individual features of the present invention are illustrated in combination with one another. Features of one exemplary embodiment may also be implemented separately from the other features of the same exemplary embodiment, and may accordingly be readily combined by an expert to form further useful combinations and sub-combinations with features of other exemplary embodiments.

Elements of identical function are denoted by the same reference designations in the Figures.

SUMMARY

A principal aspect of the present invention is an electrical plug connector (2), having an insulating part (14) and at least one inner-conductor contact element pair (15) for differential signal transmission, wherein the inner-conductor contact element pair (15) comprises a first inner-conductor contact element (16) and a second inner-conductor contact element (17), which extend through the insulating part (14) from a first end (18) of the insulating part (14) to a second end (19) of the insulating part (14), wherein the inner-conductor contact elements (16, 17), in the region of the first end (18) of the insulating part (14), have a contact section (20) for contacting of an inner conductor of a corresponding counterpart plug connector and, in the region of the second end (19) of the insulating part (14), have a press-in pin (21) for pressing into a metal-plated recess (11) of an electrical assembly (3), characterized in that the inner-conductor contact elements (16, 17) have in each case exactly one support shoulder (23) via which a pressing-in force required for the pressing of the press-in pin (21) into the metal-plated recess (11) can be introduced, wherein the support, shoulder (23) is formed between the contact section (20) and the press-in pin (21) along the central axis (M) of the inner-conductor contact element (16, 17), and wherein the inner-conductor contact elements (16, 17) have a respective support surface (24) which is averted from the support shoulder (23) and by way of which the inner-conductor contact element (16, 17) is supported in the insulating part (14).

A further aspect of the present invention is an electrical plug connector, characterized by an outer-conductor assembly (6) having a first interface (9) for the electrical and mechanical contacting of an outer conductor of the corresponding electrical counterpart plug connector and a second interface (10) for the electrical and mechanical contacting of the electrical assembly (3), wherein the insulating part (14) is received in the outer-conductor assembly (6) and is oriented with its first end (18) toward the first interface (9) and with its second end (19) toward the second interface (10).

A further aspect of the present invention is an electrical plug connector, characterized by an insulating housing assembly (4) with a mechanical interface (5) for the connection of the electrical plug connector (2) to the corresponding counterpart plug connector, wherein the outer-conductor assembly (6) is received in the housing assembly (4) and is oriented with its first interface (9) toward the mechanical interface (5).

A further aspect of the present invention is an electrical plug connector, characterized in that the support shoulder (23) directly adjoins the press-in pin (21) along the central axis (M) of the inner-conductor contact element (16, 17).

A further aspect of the present invention is an electrical plug connector, characterized in that the first inner-conductor contact element (16) and the second inner-conductor contact element (17) are arranged and formed in axially symmetrical fashion along the longitudinal axis (L) of the insulating part (14).

A further aspect of the present invention is an electrical plug connector, characterized in that the support shoulder (23) of the first inner-conductor contact element (16) and the support shoulder (23) of the second inner-conductor contact element (17) extend in opposite directions, preferably along a common orthogonal (O) relative to the respective central axis (M) of the inner-conductor contact element (16, 17).

A further aspect of the present invention is an electrical plug connector, characterized in that the insulating part (14), the outer-conductor assembly (6) and/or the housing assembly (4) have at least one engagement surface (31) for an assembling tool, by which engagement surface the pressing-in force for the pressing of the press-in pins (21) into the metal-plated recesses (11) can be introduced from the assembling tool into the support shoulders (23).

A further aspect of the present invention is an electrical plug connector, characterized in that the insulating part (14) has, on its inner side, rib-like extensions (25) with a respective lateral abutment surface (26) against which the corresponding support shoulder (23) bears in order to transmit the pressing-in force.

A further aspect of the present invention is an electrical plug connector, characterized in that the lateral abutment surface (26) is formed so as to be recessed in the rib-like extension (25) or behind a set-back portion (27) in order to provide a stop for the corresponding support shoulder (23).

A further aspect of the present invention is an electrical plug connector, characterized in that the inner-conductor contact elements (16, 17) are supported with their support surfaces (24) in the insulating part (14) via respective guide surfaces (28) formed on the inner side of the insulating part (14).

A further aspect of the present invention is an electrical plug connector, characterized in that the inner-conductor contact elements (16, 17) are led through the insulating part (14) in each case between the support surface (24) and the rib-like extension (25).

A further aspect of the present invention is an electrical plug connector, characterized in that the contact sections of the inner-conductor contact elements (16, 17) are formed as contact pins (20) or as bushing contacts.

A further aspect of the present invention is an electrical plug connector, characterized in that the inner-conductor contact elements (16, 17) are each of single-piece form.

A still further aspect of the present invention is an electrical connecting arrangement (1) having an electrical plug connector (2) and having an electrical assembly, in particular an electrical circuit board (3).

An even still further aspect of the present invention is an electrical connecting arrangement (1), characterized in that the metal-plated recesses are formed as plated through-holes (11) and/or blind bores in the electrical assembly, in particular in the electrical circuit board (3).

These and other aspects of the present invention will be fully disclosed in more detail, as is required by the statutes, herein.

BRIEF DESCRIPTIONS OF THE FIGURES

In the Figures, in each case schematically;

DETAILED WRITTEN DESCRIPTION OF THE PREFERRED EMBODIMENTS

This disclosure of the invention is submitted in furtherance of the Constitutional purposes of the US Patent Laws "to promote the progress of science and useful arts" (Article 1, Section 8).

Figure 1:
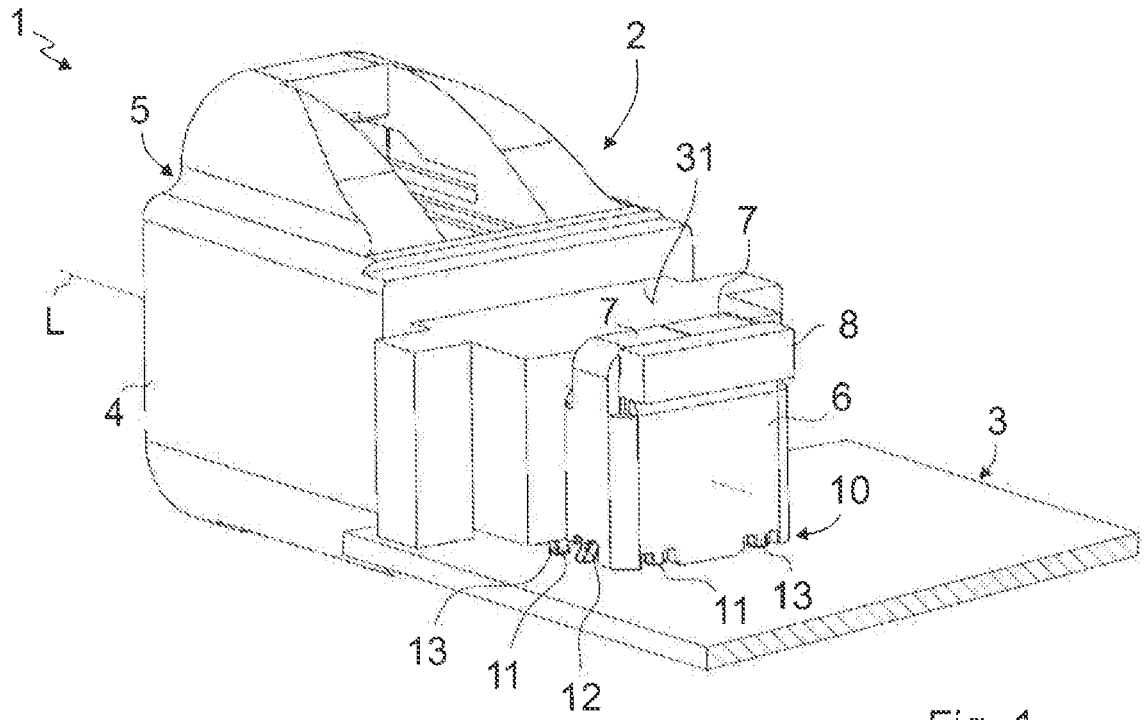
FIG. 1 shows an electrical connecting arrangement, composed of an electrical plug connector and of an electrical assembly, in a perspective view.

FIG. 1 shows an electrical connecting arrangement 1 having a first electrical plug connector 2 and an electrical assembly 3. In the exemplary embodiments, the electrical plug connector 2 is in the form of a circuit board plug connector and the electrical assembly 3 is in the form of an electrical circuit board. This is however not to be understood as limiting. It is possible in the context of the invention for any electrical plug connector 2 and any electrical assembly 3 to be provided. In the exemplary embodiments, the electrical plug connector 2 is in the form of an angled plug connector, although the electrical assembly 2 may also be in the form of a non-angled or straight plug connector.

The electrical plug connector 2 has an electrically insulating housing assembly 4 with a mechanical interface 5 for the connection of the electrical plug connector 2 to a corresponding counterpart plug connector (not illustrated). The housing assembly 4 is formed as a single piece from a plastic.

The electrical plug connector 2 furthermore has an outer-conductor assembly 6 which is received in positively locking fashion in the electrically insulating housing assembly 4. For a complete illustration, the outer-conductor assembly 6 is illustrated on its own in FIG. 2.

The fastening between the outer-conductor assembly 6 and the electrically insulating housing assembly 4 is basically arbitrary. In the exemplary embodiment, the outer-conductor assembly 6 has two bendable fastening tabs 7, in their basic state (not illustrated), the fastening tabs 7 are capable of allowing an assembling movement for the assembling of the electrically insulating housing assembly 4 on the outer-conductor assembly 6 along the longitudinal axis L of the electrically insulating housing assembly 4. By contrast, in the bent fastening state illustrated, the fastening tabs 7 are capable of blocking the electrically insulating housing assembly 4 on the outer-conductor assembly 6 in positively locking fashion. For this purpose, the electrically insulating housing assembly 4 has a fastening web 8 (cf. FIG. 1), behind the fastening edge of which the fastening tabs 7 engage.

The outer-conductor assembly 6 has a first interface 9 for the electrical and mechanical contacting of an outer conductor of the corresponding electrical counterpart plug connector. The outer-conductor assembly 6 furthermore has a second interface 10 for the electrical and mechanical contacting of metal-plated recesses 11 of the electrical assembly 3 or of the circuit board. For the contacting of the electrical assembly 3, the second interface 10 has a multiplicity of contact elements 12, 13 (of, in particular FIG. 2).

Figure 3:
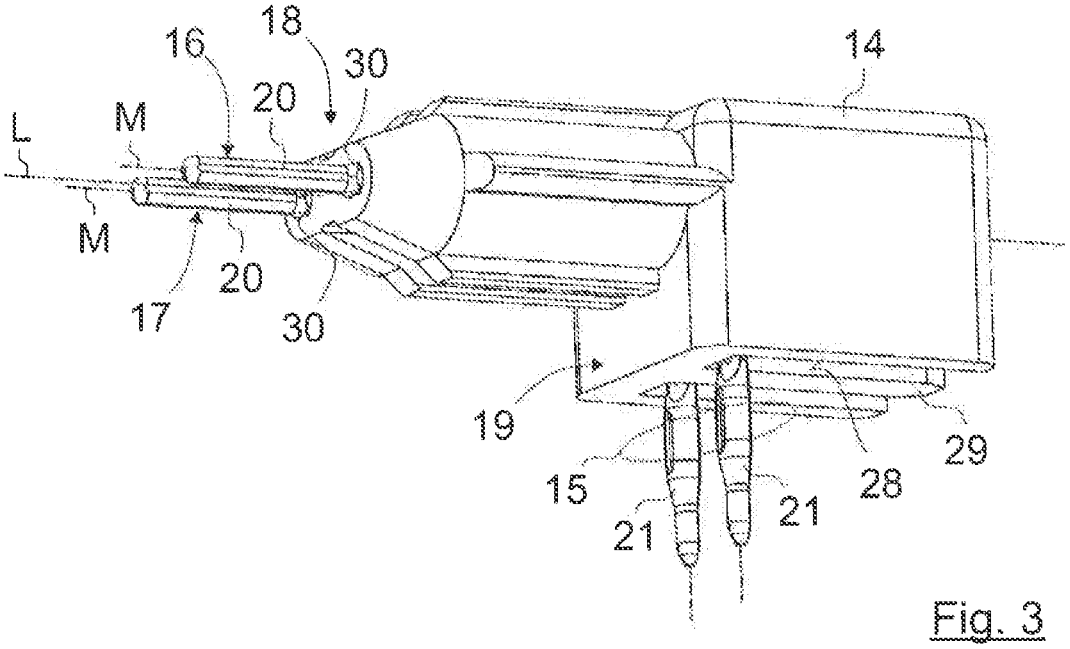
FIG. 3 shows an insulating part of the plug connector of FIG. 1 together with the inner-conductor contact elements, guided therein, of a common inner-conductor contact element pair, in a perspective view.

The electrical plug connector 2 furthermore has at insulating part 14 and at least one inner-conductor contact element pair 15 for differential signal transmission, as illustrated in FIG. 3. The first inner-conductor contact element 16 and the second inner-conductor contact element 17 of the inner-conductor contact element pair 15 are each formed as a single piece and illustrated jointly in FIG. 4.

The insulating part 14 is received in the outer-conductor assembly 6 and is positioned with its first end 18 in the first interface 9 and with its second end 19 in the second interface 10. The inner-conductor contact elements 16, 17 of the common inner-conductor contact element pair 15 extend through the insulating part 14 from the first end 18 of the insulating part 14 to the second end 19 of the insulating part 14.

The inner-conductor contact elements 16, 17, in the region of the first, end 18 of the insulating part 14, have a contact section (for example a contact pin 20, as illustrated) for contacting of an inner conductor of a corresponding counterpart plug connector and, in the region of the second end 19 of the insulating part 14, have a press-in pin 21 for pressing into a respective corresponding metal-plated recess 11 defined in the electrical assembly 3. By means of the insulating part 14, the inner-conductor contact elements 16, 17 can be sufficiently fixed in the electrical plug connector 2 and electrically insulated with respect to the outer-conductor assembly 6.

The outer-conductor assembly 6 may on the one hand serve for electromagnetically shielding the inner-conductor contact elements 16, 17. The outer-conductor assembly 6 may furthermore perform the function of an electrical outer conductor for transmitting an electrical reference signal in the context of the signal transmission.

Figure 2:
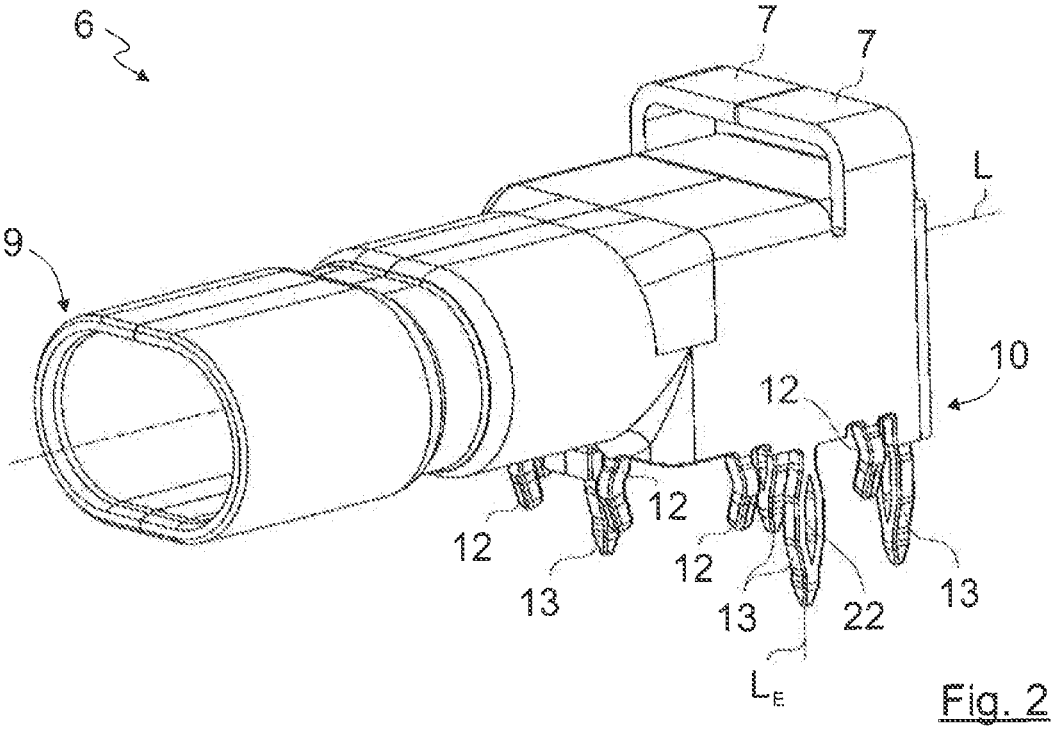
FIG. 2 shows the outer-conductor assembly of the plug connector of FIG. 1 in a perspective view.

For the contacting of the electrical assembly 3 or of the circuit board, it is provided that the contact elements 12, 13 of the outer-conductor assembly 6 are divided into two groups (cf. FIG. 2). A first group of the contact elements 12, 13 is formed as press-in contacts 13 for an oversize fit in the metal-plated recesses 11 of the electrical assembly 3 or circuit board. A second group of the contact elements 12, 13 is formed as resilient contact elements 12 for insertion into the metal-plated recesses 11 of the electrical assembly 3 or of the circuit board. The press-in contacts 13 may in particular have, along a section of their longitudinal axis $L_E$, an elastic deformation zone 22 which is formed preferably by a central material recess in the manner of a slot or an eye of a needle, as illustrated.

Figure 4:
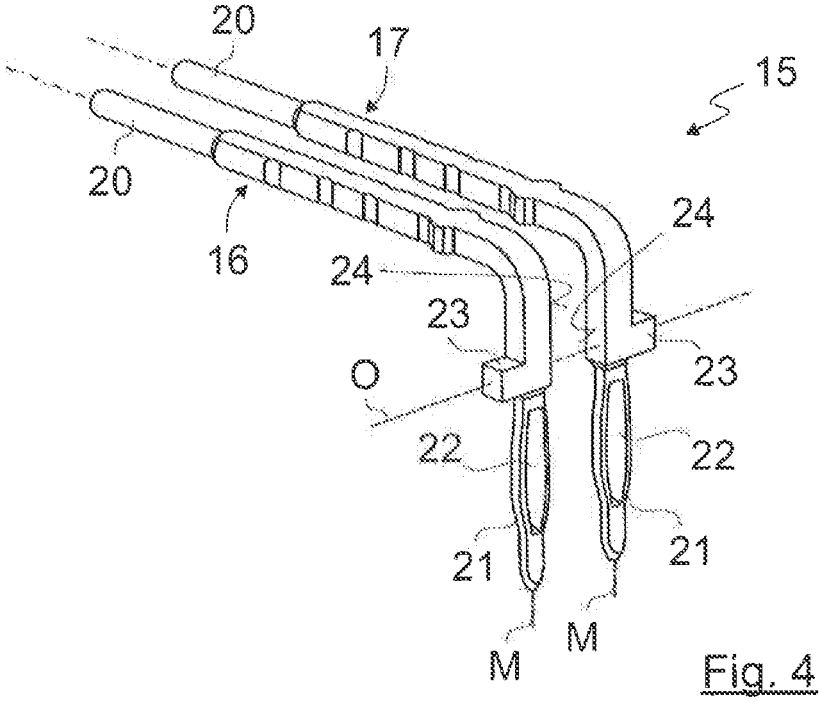
FIG. 4 shows the two inner-conductor contact elements of the plug connector of FIG. 1 in a perspective view.
Figure 5:
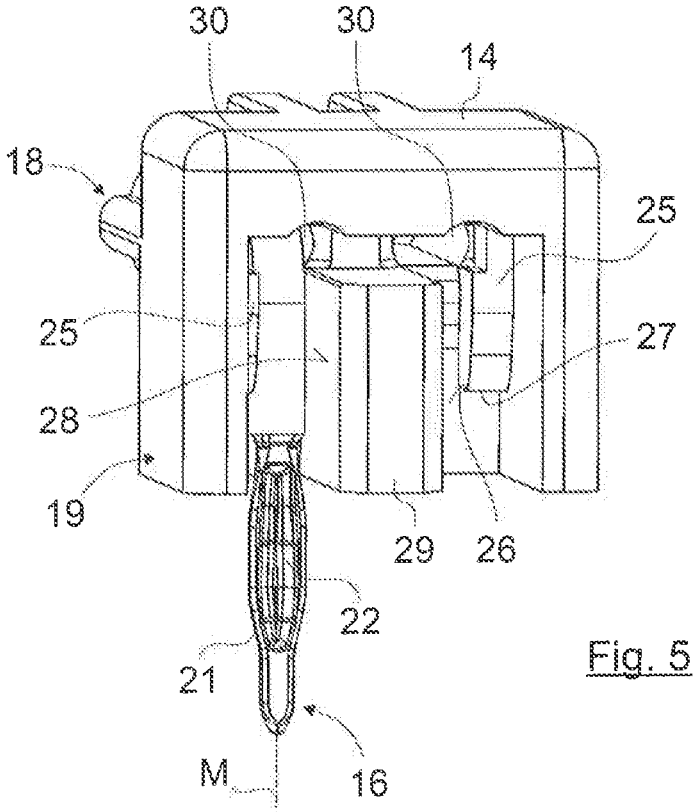
FIG. 5 shows the insulating part of FIG. 3 in a perspective view from the rear, with a single inner-conductor contact element.
Figure 6:
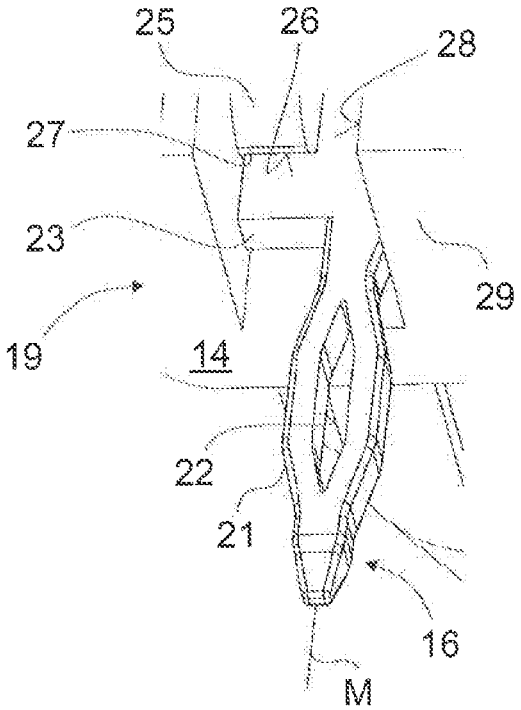
FIG. 6 shows a perspective enlarged detail view of an inner-conductor contact element of a second exemplary embodiment within the insulating part for the purposes of illustrating the transmission of force between the support shoulder and the abutment surface of the rib-like extension in the insulating part.

The press-in pins 21 of the inner-conductor contact elements 16, 17 may be of similar design (cf. for example FIG. 4 or FIG. 6). The press-in pins 21 may likewise have an elastic deformation zone 22. In the exemplary embodiment shown in FIGS. 1 to 5, the elastic deformation zone 22 is formed as a groove which does not run all the way through the material of the inner-conductor contact element 16, 17. By contrast, in the exemplary embodiment shown in FIGS. 6 and 7, the deformation zone 22 is formed as a slot which runs continuously all the way through the material.

In the exemplary embodiment, the metal-plated recesses 11 are formed as plated through-holes in the electrical circuit board 3 and are not illustrated in any more detail. The metal-plated recesses 11 may however, also be formed as blind bores or depressions.

As can be seen in particular from FIG. 4, the inner-conductor contact elements 16, 17 each have exactly one support shoulder 23. Via the support shoulder 23, a pressing-in force that is required for the pressing of the press-in pin 21 into the metal-plated recess 11 can be introduced. The support shoulder 23 is formed between the contact section 20 and the press-in pin 21 and along the central axis M of the inner-conductor contact element 16, 17. In the exemplary embodiments, the support shoulder 23 directly adjoins the press-in pin 21 along the central axis M of the inner-conductor contact element 16, 17 in order to improve the introduction of force.

Figure 7:
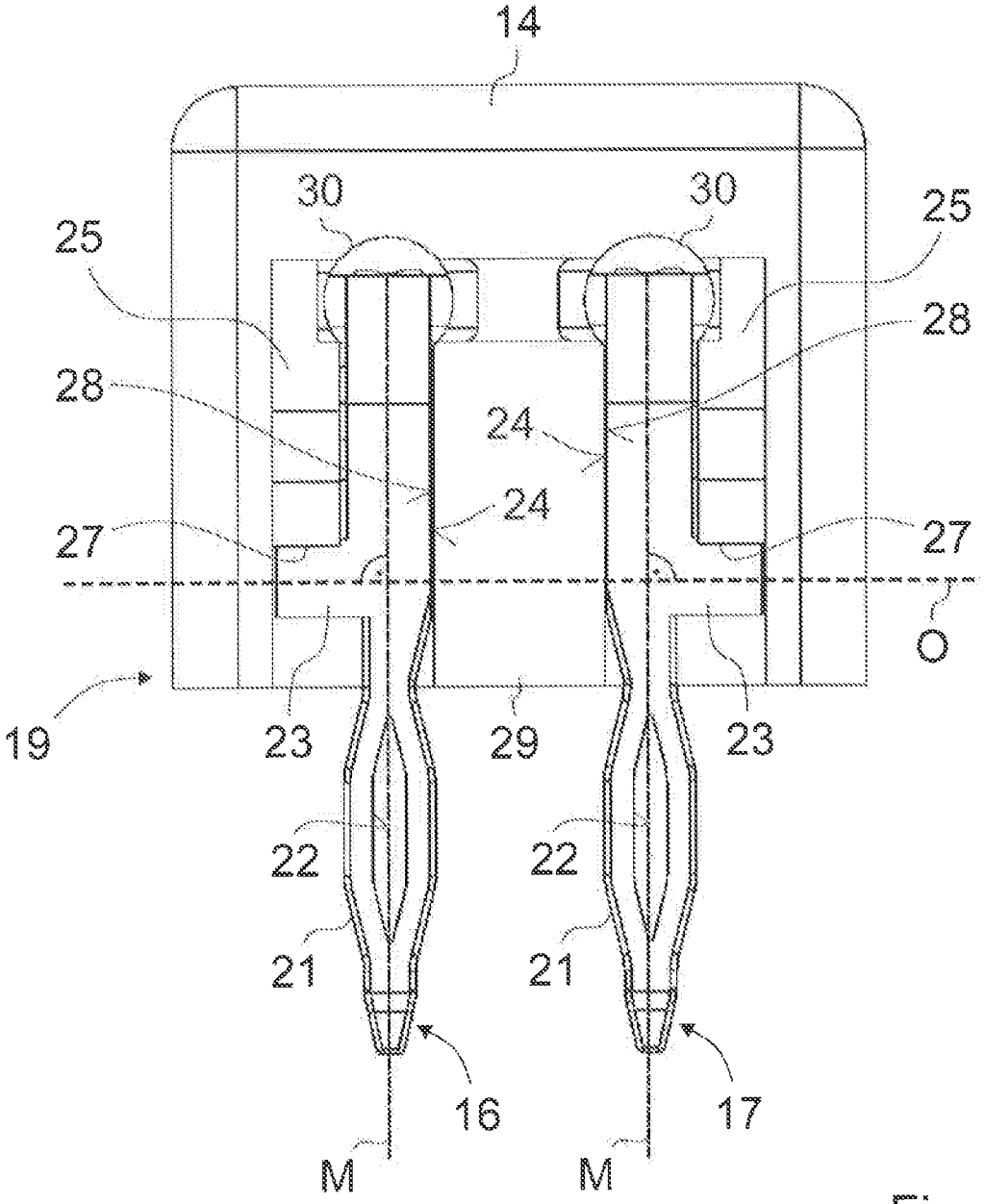
FIG. 7 shows the insulating part of FIG. 3 with inserted inner-conductor contact elements as per FIG. 6 in a rear view.

In FIGS. 3 and 7, the inner-conductor contact elements 16, 17 are illustrated as being jointly received in the insulating part 14. The first inner-conductor contact element 16 and the second inner-conductor contact element 17 are in this case arranged and formed in axially symmetrical or mirror-symmetrical fashion along the longitudinal axis L of the insulating part 14. Here, the support shoulder 23 of the first inner-conductor contact element 16 and the support shoulder 23 of the second inner-conductor contact element 17 extend in opposite directions along a common orthogonal O relative to the respective central axis M of the inner-conductor contact element 16, 17. In this way, the characteristic impedance of the electrical plug connector 2 can be optimized.

In order to allow an, as far as possible, symmetrical and uniform introduction of force despite the asymmetry of the individual inner-conductor contact elements 16, 17, the inner-conductor contact elements 16, 17 have a respective support surface 24 (cf. in particular FIG. 4) which is averted from the support shoulder 23 and via which the inner-conductor contact element 16, 17 is supported in the insulating part 14.

In FIG. 5, the insulating part 14 is illustrated with the first inner-conductor contact element 16 in a rear view. For the sake of a clearer illustration, the second inner-conductor contact element 17 has been omitted. It can be seen that the insulating part 14 has, on its inner side, rib-like extensions 25 with a respective lateral abutment surface 26 which faces toward the electrical assembly 3 and against which the corresponding support shoulder 23 bears in order to transmit the pressing-in force. Here, the lateral abutment surface 26 is formed so as to be recessed in the rib-like extension 25 or behind a set-back portion 27 in order to provide a stop for the corresponding support shoulder 23 and fix the inner-conductor contact element 16, 17 even more effectively within the insulating part 14 (cf. also FIG. 6).

The inner-conductor contact elements 16, 17 are supported with their support surfaces 24 via respective guide surfaces 28 formed on the inner side of the insulating part 14. Here, the guide surfaces 28 are formed on the surfaces, facing toward the respective inner-conductor contact element 16, 17, of an intermediate wall 29, formed between the inner-conductor contact elements 16, 17, of the insulating part 14. In the exemplary embodiments, the inner-conductor contact elements 16, 17 are, overall, led through the insulating part 14 between the support surface 24 and the rib-like extension 25. The insulating part 14 thus has a U-shaped guide for the inner-conductor contact elements 16, 17, which guide transitions into corresponding slots 30 (cf. FIGS. 5 and 7).

For the assembly of the respective inner-conductor contact element 16, 17, this can be inserted with its contact section 20 into the slot 30 and subsequently bent along the slot 30 between the support surface 24 and the rib-like extension 25 until the support shoulder 23 has reached its end position below the abutment surface 26.

In order to introduce the pressing-in force, which is provided for the pressing-in action, into the support shoulder 23, the insulating part 14, the outer-conductor assembly 6 and/or the housing assembly 4 may have at least one engagement surface 31 for a corresponding assembling tool. In the exemplary embodiment, it is provided that the housing assembly 4 has an engagement surface 31 (cf. FIG. 1) which is arranged in the region above the press-in pins 21 of the inner-conductor contact elements 16, 17. In particular, provision may be made for the press-in pins 21 of the inner-conductor contact elements and the contact elements 12, 13 of the outer-conductor assembly 6 to be pressed into the respective metal-plated recesses 11 of the electrical assembly 3 or of the circuit board.

Operation

A principal object of the present invention is an electrical plug connector (2) comprising: an insulating part (14) that has a first end (18) and a second end (19); an inner-conductor contact element pair (15) for differential signal transmission, and wherein the inner-conductor contact element pair (15) comprises, a first inner-conductor contact element, (16) and a second inner-conductor contact element (17), and wherein the first inner-conductor contact element and the second inner-conductor contact element each extend through the insulating part (14) from the first end (18) of the insulating part (14) to the second end (19) of the insulating part (14); and wherein the first and second inner-conductor contact elements, (16, 17), in a region proximate the first end (18) of the insulating part (14), each have a contact section (20) for contacting an inner conductor of a corresponding counterpart plug connector; and the first inner-conductor contact element (16) and the second inner-conductor contact element (17) in a region proximate the second end (19) of the insulating part (14), each have a press-in pin (21) for pressing into a metal-plated recess (11) of defined in an electrical assembly (3); and wherein the first and second inner-conductor contact elements (16, 17) each have exactly one support shoulder (23) via which a pressing-in force that is required for pressing of each press-in pin (21) into the metal-plated recess (11) can be introduced; and wherein the exactly one support shoulder (23) is between the contact section (20) and the press-in pin (21) and is along a central axis (M) of each of the first and second inner-conductor contact elements (16, 17); and wherein the first and second inner-conductor contact elements (16, 17) each have a support surface (24) which is averted from the support shoulder (23) so that each of the first and second inner-conductor contact elements (16, 17) is supported in the insulating part (14).

A further object of the present invention is an electrical plug connector (2) and further comprising: an outer-conductor assembly (6) which has a first interface (9) for electrically and mechanically contacting an outer conductor of the corresponding electrical counterpart plug connector and, a second interface (10) for electrically and mechanically contacting the electrical assembly (3); and the insulating part (14) is received in the outer-conductor assembly (6) and the insulating part is oriented with the first end (18) toward the first interface (9) and with the second end (19) toward the second interface (10).

A further object of the present invention is an electrical plug connector (2) and further comprising: an insulating housing assembly (4) that has a mechanical interface (5) for connection of the electrical plug connector (2) to the corresponding counterpart plug connector; and the outer-conductor assembly (6) is received in the insulating housing assembly (4) and the outer-conductor assembly is oriented with the first interface (9) toward the mechanical interface (5).

A further object of the present invention is an electrical plug connector (2) and wherein the exactly one support shoulder (23) directly adjoins the press-in pin (21) along the central axis (M) of the first and second inner-conductor contact elements (16, 17).

A further object of the present invention is an electrical plug connector (2) wherein the first inner-conductor contact element (16), and the second inner-conductor contact element (17) are arranged in axially symmetrical fashion along a longitudinal axis (L) of the insulating part (14).

A further object of the present invention is an electrical plug connector (2) wherein the exactly one support shoulder (23) of the first inner-conductor contact element (16), and the exactly one support shoulder (23) of the second inner-conductor contact element (17) extend in opposite directions, preferably along a common orthogonal (0) relative to the central axis (M) of the respective first and second inner-conductor contact element (16, 17).

A further object of the present invention is an electrical plug connector (2) and further comprising an engagement surface (31) on at least one of the insulating part (14), or the outer-conductor assembly (6), or the housing assembly (4) for an assembling tool; and the engagement surface (31) facilitates the pressing-in force for the pressing of the press-in pins (21) into the metal-plated recesses (11) introduced by the assembling tool.

A further object of the present invention is an electrical plug connector (2) wherein the insulating part (14) has, an inner side and on the on its inner side, the insulating part has rib-like extensions (25) and each rib-like extension (25) has a lateral abutment surface (26) against which the support shoulder (23) of the corresponding first and second inner-conductor contact element (16, 17) bears in order to transmit the pressing-in force.

A further object of the present invention is an electrical plug connector (2) wherein the lateral abutment surface (26) is recessed in the rib-like extension (25) to provide a stop for the corresponding support shoulder (23).

A further object of the present invention is an electrical plug connector (2) wherein the first and second inner-conductor contact elements (16, 17) are supported with their respective support surfaces (24) in the insulating part (14) via guide surfaces (28) formed on an inner side of the insulating part (14).

A further object of the present invention is an electrical plug connector (2) wherein the first and second inner-conductor contact elements (16, 17) extend through the insulating part (14) between the support surface (24) and the rib-like extension (25).

A further object of the present invention is an electrical plug connector (2) wherein the contact sections of the first and second inner-conductor contact elements (16, 17) are contact pins (20).

A further object of the present invention is an electrical plug connector (2) wherein the first and second inner-conductor contact elements (16, 17) are each of single-piece form.

A further object of the present invention is an electrical connecting arrangement (1) comprising: an electrical plug connector (2) having, an insulating part (14) that has a first end (18), and a second end (19), and an inner-conductor contact element pair (15) for differential signal transmission, and wherein the inner-conductor contact element pair (15) comprises, a first inner-conductor contact element (16) and a second inner-conductor contact element (17), and wherein the first inner-conductor contact element (16) and the second inner-conductor contact element (17) each extend through the insulating part (14) from the first end (18) of the insulating part (14) to the second end (19) of the insulating part (14), and the first and second inner-conductor contact elements (16, 17), in a region proximate the first end (18) of the insulating part (14), each have a contact section for contacting an inner conductor of a corresponding counterpart plug connector, and the first inner-conductor contact element and the second inner-conductor contact element (16, 17) in a region proximate the second end (19) of the insulating part (14), each have a press-in pin (20) for pressing into a metal-plated recess (11) defined in an electrical assembly, and wherein the first and second inner-conductor contact elements (16, 17) each have exactly one support shoulder via which a pressing-in force that is required for pressing of each press-in pin (20) into the metal-plated recess (11) can be introduced, and wherein the exactly one support shoulder is between the contact section and the press-in pin (20) and is along a central axis (M) of each of the first and second inner-conductor contact elements (16, 17), and wherein the first and second inner-conductor contact elements (16, 17) each have a support surface which is averted from the support shoulder so that each of the first and second inner-conductor contact elements (16, 17) is supported in the insulating part (14); and an electrical assembly, in particular an electrical circuit board (3).

A further object of the present invention is an electrical connecting arrangement (1) wherein the metal-plated recesses (11) are plated through-holes (11) in the electrical assembly, in particular in the electrical circuit board (3).

A further object of the present invention is an electrical plug connector (2) as wherein the lateral abutment surface is behind a set-back portion to provide a stop for the corresponding support shoulder.

A further object of the present invention is an electrical plug connector (2) wherein the contact sections of the first and second inner-conductor contact elements (16, 17) are bushing contacts.

A still further object of the present invention is an electrical connecting arrangement (1) wherein the electrical assembly (3) is an electrical circuit board.

An even still further object of the present invention is an electrical plug connector (2) wherein the metal plated recesses (11) are blind bores in the electrical assembly (1).

In compliance with the statute, the present invention has been described in language more or less specific, as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalents.

The invention claimed is:

1. An angled electrical plug connector comprising:

an insulating part that has a first end and a second end, and the insulating part defines an angle between the first end and the second end;

an inner-conductor contact element pair for differential signal transmission, and wherein the inner-conductor contact element pair comprises, a first inner-conductor contact element, and a second inner-conductor contact element, and wherein the first inner-conductor contact element and the second inner-conductor contact element each extend through the angled insulating part from the first end of the angled insulating part, and through the angle, to the second end of the angled insulating part; and wherein the first and second inner-conductor contact elements, in a region proximate the first end of the angled insulating part, each have a contact section for contacting an inner conductor of a corresponding counterpart plug connector; and the first inner-conductor contact element and the second inner-conductor contact element in a region proximate the second end of the angled insulating part, each have a press-in pin for pressing into a metal-plated recess defined in an electrical assembly; and wherein the first inner-conductor contact element, and the second inner-conductor contact element each define a single centerline that extends from the contact section of the respective inner-conductor contact element through the press-in pin of the respective inner-conductor contact element; and wherein the first and second inner-conductor contact elements each have exactly one support shoulder via which a pressing-in force that is required for pressing of each press-in pin into the metal-plated recess can be introduced; and wherein the exactly one support shoulder is proximate the press-in pin and is laterally displaced from the single centerline of each of the first and second inner-conductor contact elements so that the pressing-in force applied to the exactly one support shoulder acts parallel to the single centerline but not along the single centerline; and wherein the first and second inner-conductor contact elements each have a support surface which is averted from the exactly one support shoulder so that each of the first and second inner-conductor contact elements is supported in the angled insulating part; and wherein the first inner-conductor contact element and the second inner-conductor contact element are each angled such that the contact section of the first inner-conductor contact element is angular relative to the press-in pin of the first inner-conductor contact element, and the contact section of the second inner-conductor contact element is angular relative to the press-in pin of the second inner-conductor contact element respectively; and wherein the exactly one support shoulder of the first inner-conductor contact element and the exactly one support shoulder of the second inner-conductor contact element point in opposite directions.

2. The electrical plug connector as claimed in claim 1 and further comprising:

an outer-conductor assembly which has, a first interface for electrically and mechanically contacting an outer conductor of the corresponding electrical counterpart plug connector and, a second interface for electrically and mechanically contacting the electrical assembly; and the insulating part is received in the outer-conductor assembly and the insulating part is oriented with the first end toward the first interface and with the second end toward the second interface.

3. The electrical plug connector as claimed in claim 2 and further comprising:

an insulating housing assembly that has a mechanical interface for connection of the electrical plug connector to the corresponding counterpart plug connector; and the outer-conductor assembly is received in the insulating housing assembly and the outer-conductor assembly is oriented with the first interface toward the mechanical interface.

4. The electrical plug connector as claimed in claim 1 and wherein the exactly one support shoulder directly adjoins the press-in pin of the first and second inner-conductor contact elements.

5. The electrical plug connector as claimed in claim 1 and wherein the first inner-conductor contact element, and the second inner-conductor contact element are arranged in axially symmetrical fashion along a longitudinal axis (L) of the insulating part.

6. The electrical plug connector as claimed in claim 1 and wherein the exactly one support shoulder of the first inner-conductor contact element, and the exactly one support shoulder of the second inner-conductor contact element extend in opposite directions, preferably along a common orthogonal (O) relative to the single centerline of the respective first and second inner-conductor contact element.

7. The electrical plug connector as claimed in claim 1 and further comprising:

an engagement surface on at least one of the insulating part, or the outer-conductor assembly, or a housing assembly for an assembling tool; and the engagement surface facilitates the pressing-in force for the pressing of the press-in pins into the metal-plated recesses introduced by the assembling tool.

8. The electrical plug connector as claimed in claim 1 and wherein the insulating part has, an inner side and on the inner side, the insulating part has rib-like extensions and each rib-like extension has a lateral abutment surface against which the exactly one support shoulder of the corresponding first and second inner-conductor contact element bears in order to transmit the pressing-in force.

9. The electrical plug connector as claimed in claim 8 and wherein the lateral abutment surface is recessed in the rib-like extension to provide a stop for the corresponding exactly one support shoulder.

10. The electrical plug connector as claimed in claim 1 and wherein the first and second inner-conductor contact elements are supported with their respective support surfaces in the insulating part via guide surfaces formed on an inner side of the insulating part.

11. The electrical plug connector as claimed in claim 8 and wherein the first and second inner-conductor contact elements extend through the insulating part between the support surface and the rib-like extension.

12. The electrical plug connector as claimed in claim 1 and wherein the contact sections of the first and second inner-conductor contact elements are contact pins.

13. The electrical plug connector as claimed in claim 1 and wherein the first and second inner-conductor contact elements are each of single-piece form.

14. The electrical plug connector as claimed in claim 8 and wherein the lateral abutment surface is behind a set-back portion to provide a stop for the corresponding support shoulder.

15. The electrical plug connector as claimed in claim 1 and wherein the contact sections of the first and second inner-conductor contact elements are bushing contacts.

16. An electrical connecting arrangement comprising:

an angled electrical plug connector having, an insulating part that has a first end and a second end, and the insulating part defines an angle between the first end and the second end;

an inner-conductor contact element pair for differential signal transmission, and wherein the inner-conductor contact element pair comprises, a first inner-conductor contact element, and a second inner-conductor contact element, and wherein the first inner-conductor contact element and the second inner-conductor contact element each extend through the angled insulating part from the first end of the angled insulating part, and through the angle, to the second end of the angled insulating part; and wherein the first and second inner-conductor contact elements, in a region proximate the first end of the angled insulating part, each have a contact section for contacting an inner conductor of a corresponding counterpart plug connector; and the first inner-conductor contact element and the second inner-conductor contact element in a region proximate the second end of the angled insulating part, each have a press-in pin for pressing into a metal-plated recess defined in an electrical assembly; and wherein the first inner-conductor contact element, and the second inner-conductor contact element each define a single centerline that extends from the contact section of the respective inner-conductor contact element through the press-in pin of the respective inner-conductor contact element; and wherein the first and second inner-conductor contact elements each have exactly one support shoulder via which a pressing-in force that is required for pressing of each press-in pin into the metal-plated recess can be introduced; and wherein the exactly one support shoulder is proximate the press-in pin and is laterally displaced from the single centerline of each of the first and second inner-conductor contact elements so that the pressing-in force applied to the exactly one support shoulder acts parallel to the single centerline but not along the single centerline; and wherein the first and second inner-conductor contact elements each have a support surface which is averted from the exactly one support shoulder so that each of the first and second inner-conductor contact elements is supported in the angled insulating part; and wherein the first inner-conductor contact element and the second inner-conductor contact element are each angled such that the contact section of the first inner-conductor contact element is angular relative to the press-in pin of the first inner-conductor contact element, and the contact section of the second inner-conductor contact element is angular relative to the press-in pin of the second inner-conductor contact element respectively; and wherein the exactly one support shoulder of the first inner-conductor contact element and the exactly one support shoulder of the second inner-conductor contact element point in opposite directions; and an electrical assembly that defines plural spacedly arrayed metal-plated recesses into which the press-in pins of the first and second inner-conductor contact elements are pressed in and operatively engage.

17. The electrical connecting arrangement as claimed in claim 16 and wherein the metal-plated recesses are plated through-holes in the electrical assembly.

18. The electrical connecting arrangement as claimed in claim 16 and wherein the electrical assembly is an electrical circuit board.

19. The electrical connecting arrangement as claimed in claim 16 and wherein the metal-plated recesses are blind bores in the electrical assembly.

20. An angled electrical plug connector comprising:

an electrically insulating housing assembly that has a mechanical interface for connection to a corresponding counterpart plug connector, and the electrically insulating housing assembly has an engagement surface; and an insulating part that has a first end and a second end, and the insulating part defines an angle between the first end and the second end; and an inner-conductor contact element pair for differential signal transmission, and wherein the inner-conductor contact element pair comprises, a first inner-conductor contact element, and a second inner-conductor contact element, and wherein the first inner-conductor contact element and the second inner-conductor contact element each extend through the angled insulating part from the first end of the angled insulating part, and through the angle, to the second end of the angled insulating part; and wherein the first and second inner-conductor contact elements, in a region proximate the first end of the angled insulating part, each have a contact section for contacting an inner conductor of a corresponding counterpart plug connector; and the first inner-conductor contact element and the second inner-conductor contact element in a region proximate the second end of the angled insulating part, each have a press-in pin for pressing into a metal-plated recess defined in an electrical assembly; and wherein the first inner-conductor contact element, and the second inner-conductor contact element each define a single centerline that extends from the contact section of the respective inner-conductor contact element through the press-in pin of the respective inner-conductor contact element; and wherein the first and second inner-conductor contact elements each have exactly one support shoulder via which a pressing-in force that is required for pressing of each press-in pin into the metal-plated recess can be introduced; and wherein the exactly one support shoulder is proximate the press-in pin and is laterally displaced from the single centerline of each of the first and second inner-conductor contact elements so that the pressing-in force applied to the exactly one support shoulder acts parallel to the single centerline but not along the single centerline; and wherein the first and second inner-conductor contact elements each have a support surface which is averted from the support shoulder so that each of the first and second inner-conductor contact elements is supported in the angled insulating part; and wherein the first inner-conductor contact element and the second inner-conductor contact element are each angled such that the contact section of the first inner-conductor contact element is angular relative to the press-in pin of the first inner-conductor contact element, and the contact section of the second inner-conductor contact element is angular relative to the press-in pin of the second inner-conductor contact element respectively; and wherein the exactly one support shoulder of the first inner-conductor contact element and the exactly one support shoulder of the second inner-conductor contact element point in opposite directions; and wherein the engagement surface of the electrically insulating housing assembly is in a region above the press-in pins of the first and second inner-conductor contact elements, and the engagement surface of the electrically insulating housing assembly is configured to receive the pressing-in force of an assembling tool for pressing the press-in pins into the metal plated recesses of the electrical assembly.

21. The angled electrical plug connector of claim 20 and further comprising:

a surface profile defined on the first inner conductor contact element, and the surface profile is between the angle and the contact section proximate the first end portion thereof, and a surface profile defined on the second inner conductor contact element, and the surface profile is between the angle and the contact section proximate the first end portion thereof; and the surface profile of the first inner contact element, and the surface profile of the second inner contact element each provide a friction fit in a corresponding mating slot defined in the angled insulating part when the respective inner contact element is pressed into the respective mating slot.

* * * * *